US005507400A

United States Patent [19]

Long et al.

[11] Patent Number: 5,507,400

[45] Date of Patent: Apr. 16, 1996

[54] SLACKLESS DRAWBAR OR COUPLER WITH SWIVEL MOUNTING

[75] Inventors: Jack R. Long, St. Charles; Andreas M. Haas, Addison, both of Ill.

[73] Assignee: National Castings Incorporated, Downers Grove, Ill.

[21] Appl. No.: 251,841

[22] Filed: Jun. 1, 1994

[51] Int. Cl.[6] ..... B61G 1/00

[52] U.S. Cl. ..... 213/75 R; 213/62 A

[58] Field of Search ..... 213/75 R, 62 A, 213/61, 62 R, 68, 69

[56] References Cited

U.S. PATENT DOCUMENTS

| | | | |
|---|---|---|---|
| 4,258,628 | 3/1981 | Altherr | 213/75 R |
| 4,428,489 | 1/1984 | Hanula | 213/62 A |
| 4,966,291 | 10/1990 | Glover | 213/62 A |

FOREIGN PATENT DOCUMENTS

| | | | |
|---|---|---|---|
| 493239 | 10/1938 | United Kingdom | 213/174 |

OTHER PUBLICATIONS

Brochure–Nat.Rotary Type F Couplers By Nat. Castings Co; Dated Oct. 29, 1963.

*Primary Examiner*—Robert J. Oberleitner

*Assistant Examiner*—C. T. Bartz

[57] ABSTRACT

A slackless drawbar or coupler head rotary connection between adjacent cars of a train which is movable along a fixed trackway, is described as having a ball and socket swivel-type connection which allows the elongated shank of a drawbar or coupler head to swivel freely in any direction, contrary to existing devices which employ a cylindrical connector which rotates in a cylindrical recess, thereby allowing the shank to rotate about its longitudinal axis rather than the center of a ball-shaped connector. In the existing designs, angling is achieved by distorting the shape of the pin hole in the shank of the drawbar or coupler head. This is undesirable and causes greater wear of the shank. The swivel connection eliminates the need for such a distorted pin hole which can be cylindrical and only slightly larger, in diameter, than that of the pin.

A plurality of tapered wedges are provided to exert pressure against a front follower to maintain it in compressive engagement with stops in the striker or housing and take up any slack which develops between these parts. A second wedging mechanism can be employed between the front follower and rear end of the shank to maintain pressure against the shank and eliminate any slack which develops between these components.

20 Claims, 2 Drawing Sheets

2
1
12
11
6
25
9
5
22
33
32
14
27
10
23
24
17
16
15
18
19
20
21
7
8
35
S
S1
28
30
31
29
M 4
3
12
11
9
6
5
25
22
33
32
14
34
27
10
23
15
36
50
48
35
38
41
22
21
40
42
39
37
47
45
24
46
7
49
28
30
31
M
29
8

SLACKLESS DRAWBAR OR COUPLER WITH SWIVEL MOUNTING

BACKGROUND OF THE INVENTION

The invention relates to rotary railroad car couplers and drawbars, wherein the individual cars of a train are separately rotated to an inverted position where the contents of the car falls, by gravity, into a hopper or bin which is positioned to receive the material being dumped from the car. During the dumping operation, the cars are maintained in coupled relation.

U.S. Pat. No. 4,128,178 is typical of the many patents relating to rotary F-type couplers, wherein the shank of the coupler is pinned to a cylindrical connector which is rotatable in a similarly shaped recess that is formed in a yoke or housing which is secured to a subsill that is located at each end of a railroad car. Such couplers employ some type of a draft gear or cushioning device for dampening forces imparted to the coupler during operation of a train which is made up of railroad cars with rotary F-couplers.

U.S. Pat. No. 5,096,075 is typical of the many patents relating to rotary drawbars which are called "slackless", because they to not employ any cushioning devices. Rather, they use a system of tapered shims or wedges to take up any slack between the various parts of the rotary mechanism of the drawbar.

Two important criteria must be met in the design of a rotary coupler or drawbar. Firstly, they must be able to rotate freely about their longitudinal axes and, secondly, they must be able to rotate a limited distance in a vertical plane, called vertical angling, to compensate for relative vertical movement between a pair of adjacent railroad cars, as they move along a trackway. Movement, other than vertical angling between adjacent cars, is compensated for by a combination of the rotational and angling characteristics of the drawbar or coupler. The rotation of a drawbar or railroad car coupler about its longitudinal axis, is not problematical. Nor is vertical angling of such rotary devices, when they employ some type of cushioning mechanism, since there is usually enough slack and resiliency to allow vertical angling.

However, the situation is different in a slackless rotary device, where any slack or resiliency in the device is undesirable and eliminated. There is a problem of vertical angling in a slackless rotary drawbar or railroad car coupler. The '075 patent teaches one solution to this problem by the provision of a pair of special bearing blocks 3 and 32 in combination with a slackless, oblong pin hole 16, as best seen in FIGS. 1 and 2. The invention is directed to a different solution to this problem of vertical angling in a slackless, rotary device.

Briefly stated, the invention is in a slackless, rotary connection which is used between adjacent railroad cars that are movable along a fixed trackway. The connection comprises a housing for a special connector to which the butt end of a railroad car coupler head or drawbar is fastened by means of a cylindrical pin. The connector is generally ball shaped and designed to swivel freely in a spherical recess which is formed in the housing. This particular rotary connection resembles a ball and socket type swivel joint which allows both rotation and angling, as previously described.

Another aspect of the invention is the provision of a wedging mechanism between the front follower and butt end of the shank of the coupler head or drawbar, to take up any slack which develops between these two components during operation of the rotary connection.

DESCRIPTION OF THE DRAWING

The following description of the invention will be better understood by having reference to the accompanying drawing, wherein.

DETAILED DESCRIPTION OF THE DRAWING

Figures 1, 2:
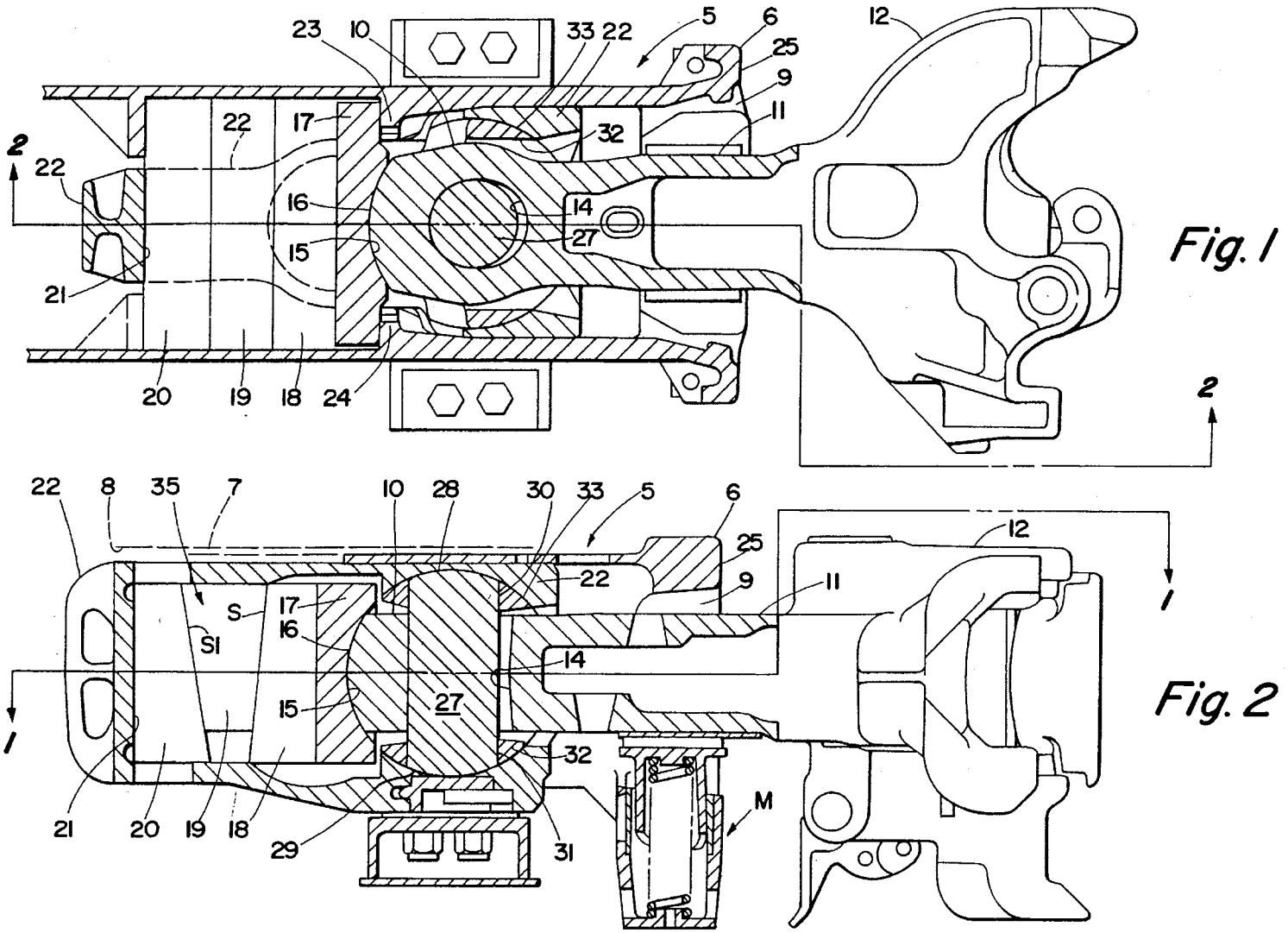
FIG. 1 is a plan view and partial section of a slackless, rotary railroad car coupler, which is made in accordance with one aspect of the invention and seen from the line 1—1 of FIG. 2.
FIG. 2 is a side view and partial section of the coupler, as seen from the line 2—2 of FIG. 1.

With general reference to the drawing for like parts and particular reference to FIGS. 1 and 2, there is shown, for example, a rotary F-type railroad car coupler 5 which, for convenience of the following description, is assumed to be in a horizontal position. The F coupler 5 is mounted within a striker or housing 6 which is secured to a subsill 7 that is located adjacent each of the opposing ends of a railroad car body 8. The housing 6 has a large, centrally disposed opening 9 which extends inwardly of the housing 6 for receiving the butt end 10 0f an elongated shank 11 which extends outwardly of the housing 6 and terminates at a coupler head 12. The elongated shank 11 would terminate at a similar, but oppositely disposed butt end 10, if a drawbar were used instead of a railroad car coupler 5, to couple together a pair of adjacent railroad cars.

It should be apparent to those skilled in the art that the shank of a drawbar is substantially longer and more solid than that of a railroad car coupler, and that the following described rotary mechanism of this invention can be interchangeably used with a drawbar or railroad car coupler.

A single, cylindrical pin hole 14 extends transversely through the butt end 10 of the shank 11 adjacent a parti-spherical rear end 15 of the shank 11 which is designed for seating engagement with a mating, parti-spherical seat 16 which is recessed in an axially aligned front follower 17 which is basically a rectangular block that is biased or forced against the rear end 15 of the shank 11 by a plurality of vertically disposed, tapered shims or wedges 18–20 which are positioned in side-by-side wedging relation between the front follower 17 and the axially spaced, at least partially closed back end 21 of a yoke 22 which is concentrically disposed within the housing 6 in horizontal, axial alignment with the shank 11.

The two outer wedges 18 and 20, as best seen FIG. 1, have tapered confronting surfaces S and S1 which converge in a direction away from the overhead car body 8 and form between them a space or slot for receiving the matingly shaped, intermediate tapered wedge 19 which is designed to fall, by gravity, deeper into the space between the two outer wedges 18 and 19 to provide, in essence, a self-adjusting wedging mechanism for eliminating any slack which develops between the front follower 17 and wedges 18–20 due to wear. This self-adjusting wedging mechanism acts to maintain pressure against the front follower 17 and butt end 11 of the rotary drawbar or coupler head 12. More importantly, it acts to keep the front follower 17 in compressive engagement with a pair of stops 23 and 24 which are formed in the housing 6 and extend towards each other in equally spaced relation from the front end 25 of the housing 6 closest the coupler head 12.

The pin hole 14 is designed to receive a cylindrical pin 27 which has a pair of partispherical opposing ends 28 and 29 which extend into, and terminate in, a pair of opposing, aligned pin holes 30 and 31 in a pin connector 32 which at least partially surrounds the butt end 11 of the shank 12 in the area of the pin hole 14. The pin connector 32 is generally hollow and essentially ball shaped or at least parti-spherical. The pin connector 32 is designed to swivel freely about its center in at least a partispherical recess or socket 33 which is formed in the yoke 22 adjacent the stops 23,24 of the housing 6. Thus, there is formed a commonly known ball and socket type swivel joint which allows the connector 32 and attached shank 11 of a drawbar or coupler head to rotate and angle in any direction. Actually, the parti-spherical read end 15 of the shank 11 and the parti-spherical seat 16 in the front follower 17 help to form the ball and socket swivel joint which allows the necessary rotation and angling required of a drawbar or coupler head 12. Any suitable means, such as the size of the opening 9 in the housing 6 or the spring mechanism, generally indicated at M, can be used to limit the rotation or swivelling of the drawbar or coupler head 12.

Figures 3, 4:
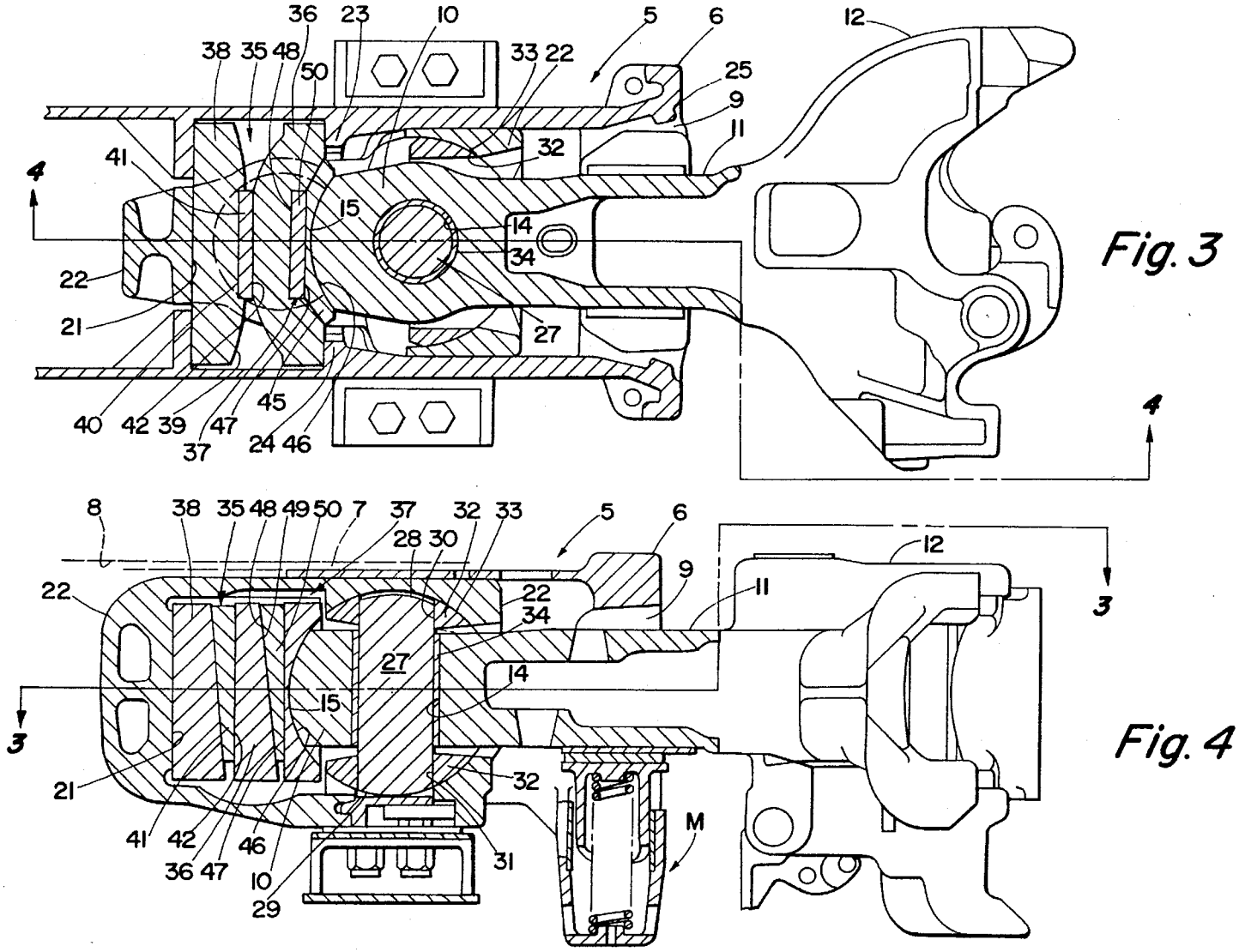
FIG. 3 is a plan view and partial section of a slackless, rotary railroad car coupler, which is made in accordance with another aspect of the invention and seen from the line 3—3 of FIG. 4.
FIG. 4 is a side view and partial section of the coupler of FIG. 3, as seen from the line 4—4 of FIG. 3.

The pin hole 14 in the butt end 10 of a slackless, rotary drawbar or coupler head 12, can be conventionally oblong shaped, as seen in FIGS. 1 and 2, without detracting from the invention. However, it is best to provide a uniformly sized, cylindrical pin hole 14 which slightly larger, in diameter, than the outside diameter of the cylindrical pin 27 to keep slack at a minimum between these two parts. Better yet is the provision of a hollow, cylindrical, hardened metal liner 34, as seen in FIGS. 3 and 4, in the cylindrical pin hole 14 to save wear on the butt end 10 of the drawbar or coupler head 12, since the butt end 10 is normally made of softer metallic material than the pin 27 which couples the butt end 10 to the pin connector 32. Thus, there has been described a self-adjusting wedging mechanism 35 which is located aft or behind the front follower 117, relative to the distance from the pin hole 14 and coupler head 12, to maintain the front follower 17 in compressive engagement with the stops 23 and 24 within the housing 6.

With particular reference to FIGS. 3 and 4, there is shown another aspect of the invention; namely, I) a first, similar self-adjusting wedging mechanism 35 which is also located aft or behind the front follower 36 for eliminating any slack which develops between the front follower 36 and associated wedging mechanism 35, to maintain the front follower 36 in compressive engagement with the stops 23 and 24 of the housing 6, and II) a second and different self-adjusting wedging mechanism, generally indicated at 37, which is located fore or in front of the front follower 36 closer the pin hole 14 and coupler head 12, to take up or eliminate any slack which develops between the partispherical end 15 of the shank 11 and the front follower 36 due to wear. The second wedging mechanism 37 actually extends the life of the coupler head 12 and attached shank 11, as will become apparent from the following description.

The first wedging mechanism 35 comprises a rear follower 38 which abuts the at least partially closed end 21 of the yoke 22 and is axially aligned and spaced from the front follower 36. The surface 39 of the rear follower 38 which confronts the front follower 36, is provided with a vertically inclined slot or groove 40 which has a width that is substantially narrower than the corresponding width of the rear follower 38, as best seen from FIG. 3. The inclined slot 40 is designed to receive a matingly tapered shim or wedge 41 which engages a vertically flat back side 42 of the front follower 36 which confronts, and is spaced from, the surface 39 of the rear follower 38 in which the slot 40 is formed. It can be appreciated that the tapered wedge 41 will fall, by gravity, to eliminate any slack which develops between the front and rear followers 36 and 38, respectively.

The second wedging mechanism 37 comprises a hardened metal cap 45 which, like a conventional front follower, is provided with a parti-spherical seat 46 against which the matingly shaped, parti-spherical rear end 15 of the coupler head shank 11 is seated. The cap 45 has a vertical back side 47 which is flat and confronts a vertically inclined slot or groove 48 which is formed in the confronting surface 49 of the front follower 36. A matingly tapered shim or wedge 50 is positioned in the groove 48 and is, likewise, designed to fall, by gravity, deeper into the groove 48 to eliminate any slack which develops between the front follower 36 and the adjacent rear end 15 of the shank 11 due to wear, especially of the shank 11 which does not require replacement as often, since it is easier and more economical to replace the cap 45 and associated wedge 50, if needed.

Thus, there has been described a unique, slackless, rotary drawbar or coupler connection which can be used between adjacent, standard size railroad cars or cars of a unit train. The aforementioned slackless connections employ a totally different ball and socket, swivel-type connection for allowing rotation and vertical angling of a drawbar or railroad car coupler. Moreover, a unique, self-adjusting wedging mechanism is described for maintaining pressure against the butt end of the shank of a drawbar or coupler, even after the shank is sufficiently worn to require replacement.

What is claimed is:

1. A rotary connection used between adjacent cars which are movable along a fixed trackway, comprising:

a) a housing at each end of the cars and having an opening in one end thereof, and at least a parti-spherical recess formed in the housing in spaced relation from the opening;

b) an elongated shank having a longitudinal axis and a butt end which terminates at a curved rear end, the butt end having a pin hole which extends transversely therethrough adjacent the rear end, the butt end extending into the housing through the opening therein;

c) a connector at least partially surrounding the butt end of the shank in the area of the pin hole, the connector having a center and a pair of oppositely aligned pin holes which are designed for alignment with the pin hole in the butt end on opposite sides of the butt end of the shank, the connector being matingly shaped to swivel and rotate freely in any direction about its center within the at least parti-spherical recess in the housing, as distinguished from rotating only about the longitudinal axis of the shank; and d) a cylindrical pin disposed in the pinholes of the connector and butt end of the shank for coupling them together for unitary movement.

2. The rotary connection of claim 1, wherein the curved rear end of the shank is parti-spherical and seats in abutting relation in a mating, parti-spherical seat which is recessed in a front follower which is disposed in a plane which is normal to the longitudinal axis of the shank, when the shank and housing are horizontally disposed.

3. The rotary connection of claim 2, which includes:

e) means for engaging the front follower and pressing it against the rear end of the shank; and f) means for limiting movement of the front follower in a direction towards the butt end of the shank.

4. A rotary connection used between adjacent cars which are movable along a fixed trackway, comprising:

a) a housing at each end of the cars and having an opening in one end thereof, and at least a parti-spherical recess formed in the housing in spaced relation from the opening;

b) an elongated shank having a longitudinal axis and a butt end which terminates at a curved rear end, the butt end having a pin hole which extends transversely therethrough adjacent the rear end, the butt end extending into the housing through the opening therein, the curved rear end of the shank being parti-spherical and seats in abutting relation in a mating, parti-spherical seat which is recessed in a front follower which is disposed in a plane which is normal to the longitudinal axis of the shank, when the shank and housing are horizontally disposed;

c) a connector at least partially surrounding the butt end of the shank in the area of the pin hole, the connector having a center and a pair of oppositely aligned pin holes which are designed for alignment with the pin hole in the butt end on opposite sides of the butt end of the shank, the connector being matingly shaped to swivel freely about its center within the at least parti-spherical recess in the housing;

d) a cylindrical pin disposed in the pinholes of the connector and butt end of the shank for coupling them together for unitary movement;

e) means, free of any elastomeric material, for engaging the front follower and pressing it against the rear end of the shank; and f) means for limiting movement of the front follower in a direction towards the butt end of the shank.

5. The rotary connection of claim 4, wherein the means for engaging and pressing the front follower against the rear end, includes a plurality of tapered wedges positioned in the housing in abutting, side-by-side relation with the front follower, at least one of the plurality of wedges being positioned to fall, by gravity, to take up any slack which develops between the front follower and wedges, due to wear.

6. The rotary connection of claim 5, wherein the means for limiting movement of the front follower includes, a pair of opposing stops disposed in the housing in farther spaced relation from the opening in the housing than the spherical recess, the wedges being designed to maintain the front follower in compressive engagement with the stops.

7. The rotary connection of claim 5, which includes:

g) means for limiting angular rotation of the shank in at least one plane.

8. The rotary connection of claim 7, wherein the shank is part of a drawbar which is used to connect adjacent cars.

9. The rotary connection of claim 7, wherein the shank is part of a coupler head used to removably connect together adjacent railroad cars.

10. The rotary connection of claim 4 or 6, which includes means disposed between the front follower and rear end of the shank for eliminating any slack which develops between the front follower and rear end of the shank due to wear.

11. A slackless rotary connection used between adjacent cars which are movable along a fixed trackway, comprising:

a) a housing disposed at each end of a car and having a pair of opposing ends, the first of such ends having an opening therein, the housing having disposed therein, i) a pair of oppositely disposed stops which extend towards each other in equally spaced relation from the first end having the opening therein, and ii) at least a parti-spherical recess between the pair of stops and the first end of the housing;

b) an elongated shank having a longitudinal axis and a butt end which extends into the housing through the opening therein, the butt end terminating at a curved rear end and having a single pin hole which extends transversely therethrough in spaced relation from the curved rear end which is farther spaced from the first end of the housing than the pin hole, when the butt end is in the housing;

c) a connector at least partially surrounding the butt end in the area of the pin hole, the connector having therein a pair of oppositely aligned pin holes which are designed for alignment with the single pin hole in the butt end on opposite ends of the single pin hole, the connector being matingly shaped to swivel and rotate freely in any direction about its center within the at least parti-spherical recess, as distinguished from rotating only about the longitudinal axis of the shank, such that the shank can rotate freely about its longitudinal axis and angle in any direction;

d) means for limiting angling of the shank in at least one plane;

e) a cylindrical pin extending through the single pin hole in the butt end and terminating in the aligned pin holes of the rotary connector, for coupling the drawbar and connector together for unitary movement;

f) a front follower disposed in the housing in farther spaced relation from the first end of the housing than the pair of opposing stops, the front follower having recessed therein, a matingly curved seat in which the curved rear end of the butt end of the shank is seated;

g) means for exerting pressure against the front follower in a direction towards the stops to maintain the front follower in compressive engagement with the stops; and h) means for eliminating any slack which develops between the front follower and stops in the housing, due to wear which causes such slack.

12. The slackless rotary connection of claim 11, which includes:

i) means for eliminating any slack which develops between the front follower and the curved rear end of the shank, due to wear which causes such slack.

13. A slackless rotary connection used between adjacent cars which are movable along a fixed trackway, comprising:

a) a housing disposed at each end of a car and having a pair of opposing ends, the first of such ends having an opening therein, the housing having disposed therein, i) a pair of oppositely disposed stops which extend towards each other in equally spaced relation from the first end having the opening therein, and ii) at least a parti-spherical recess between the pair of stops and the first end of the housing;

b) an elongated shank having a butt end which extends into the housing through the opening therein, the butt end terminating at a curved rear end and having a single pin hole which extends transversely therethrough in spaced relation from the curved rear end which is farther spaced from the first end of the housing than the pin hole, when the butt end is in the housing;

c) a connector at least partially surrounding the butt end in the area of the pin hole, the connector having therein a pair of oppositely aligned pin holes which are designed for alignment with the single pin hole in the butt end on opposite ends of the single pin hole, the connector being matingly shaped to swivel freely within the at least parti-spherical recess, such that the shank can rotate freely about its longitudinal axis and angle at least one plane;

d) means for limiting angular rotation of the shank in the at least one plane;

e) a cylindrical pin extending through the single pin hole in the butt end and terminating in the aligned pin holes of the rotary connector, for coupling the drawbar and connector together for unitary movement;

f) a front follower disposed in the housing in farther spaced relation from the first end of the housing than the pair of opposing stops, the front follower having recessed therein, a matingly curved seat in which the curved rear end of the butt end of the shank is seated;

g) means for exerting pressure against the front follower in a direction towards the stops to maintain the front follower in compressive engagement with the stops;

h) means for eliminating any slack which develops between the front follower and stops in the housing, due to wear which causes such slack, the means for exerting pressure against the front follower and the means for eliminating slack between the front follower and stops in the housing including a plurality of tapered wedges in side-by-side abutting relation, at least one of the wedges being positioned to fall, by gravity, when slack develops between the wedges, to displace and eliminate such slack; and i) means for eliminating any slack which develops between the front follower and the curved rear end of the shank, due to wear causes such slack.

14. The slackless rotary connection of claim 13, wherein the means for eliminating any slack between the front follower and the curved rear end of the shank includes, j) a front follower with a vertically inclined slot facing the rear end of the shank, when the housing and shank are horizontally disposed, k) a cap disposed between the front follower and rear end of the shank, the cap having a matingly curved seat in which the curved rear end of the shank is seated, and m) at least one tapered wedge slidable in the inclined slot in contact with the cap, the at least one tapered wedge falling, by gravity, deeper into the slot when any slack develops between the front follower and rear end of the shank, to eliminate such slack.

15. A rotary connection between a pair of cars which are movable along a fixed trackway, comprising:

a) a housing fixedly disposed adjacent each end of a car, the housing having a centrally disposed opening which extends inwardly of the housing from a front end thereof which faces an adjacent car, the housing having a pair of stops which extend towards each other in equally spaced distance from the front end of the housing;

b) a yoke at least partially disposed within the housing, the yoke having a pair of opposing ends, the first of which ends has therein at least a parti-spherical recess in spaced relation between the stops and front end of the housing, and the second of which ends is at least partially closed and is in axial spaced relation from the first end, the second end of the yoke being farther spaced inwardly of the housing beyond the stops;

c) a generally hollow connector disposed within the yoke, the connector being at least parti-spherical and matingly shaped to swivel in the recess that is formed in the yoke;

d) an elongated shank extending into the opening of the housing and protruding therefrom, the shank having a parti-spherical rear end which extends through the connector and terminates adjacent the stops of the housing;

e) means for mounting the connector and shank together adjacent the rear end of the shank, for swiveling together, in unison;

f) a front follower disposed in the yoke in spaced relation from the recess and designed to compressively engage the stops of the housing;

g) a plurality of wedges disposed in the yoke in side-by-side abutting relation between the front follower and the at least partially closed end of the yoke, the wedges being designed to exert pressure against the front follower in a direction towards the stops to maintain the front follower in compressive engagement with the stops, at least one of the wedges designed to fall, by gravity, to eliminate any slack which develops between the stops, front follower and wedges; and h) means disposed between the front follower and rear end of the shank for exerting pressure against the rear end of the shank in a direction towards the rotary connector.

16. The rotary connection of claim 15, which includes:

i) means for eliminating any slack which develops between the front follower and rear end of the shank during operation of the rotary connection.

17. The rotary connection of claim 16, wherein the means (h) for exerting pressure against the front follower in a direction towards the rotary connector and the means (i) for eliminating slack between the front follower and rear end of the shank, includes:

j) a cap having recessed therein, a parti-spherical seat in which the matingly shaped rear end of the shank is seated; and k) a tapered wedge positioned between the front follower and cap and designed to I) exert pressure against the cap in a direction towards the rear end of the shank, and II) move, by gravity, to eliminate any slack which develops between the front follower and rear end of the shank during operation of the rotary connection.

18. The rotary connection of claim 17, wherein the means (e) for mounting the connector and shank together includes a cylindrical pin which extends through a slightly larger pin hole which extends transversely through the shank adjacent the rear end of the shank, the pin having a pair of opposing ends which terminate in a pair of adjacent, aligned pin hole in the connector.

19. The rotary connection of claim 18, wherein a coupler head is attached to the end of the shank protruding from the housing.

20. The rotary connection of claim 18, wherein the elongated shank is part of a drawbar.

* * * * *